US006019666A

United States Patent [19]

Roberts et al.

[11] Patent Number: 6,019,666

[45] Date of Patent: Feb. 1, 2000

[54] MOSAIC POLISHING PADS AND METHODS RELATING THERETO

[75] Inventors: John V. H. Roberts, Newark, Del.; Lee Melbourne Cook, Steelville, Pa.; David B. James, Newark, Del.; Heinz F. Reinhardt, Chadds Ford, Pa.

[73] Assignee: Rodel Holdings Inc., Newark, Del.

[21] Appl. No.: 09/074,667

[22] Filed: May 8, 1998

Related U.S. Application Data

[60] Provisional application No. 60/046,104, May 9, 1997.

[51] Int. Cl.[7] ..... B24B 1/00

[52] U.S. Cl. ..... 451/36; 451/550; 451/528; 451/548

[58] Field of Search ..... 451/526, 527, 451/528, 529, 530, 537, 538, 548, 550, 921

[56] References Cited

U.S. PATENT DOCUMENTS 4,918,872 4/1990 Sato et al. ..... 51/209 R
4,927,432 5/1990 Budinger et al. .
5,060,424 10/1991 Sato et al. ..... 51/209 R
5,076,024 12/1991 Akagawa et al. ..... 51/209 DL
5,209,760 5/1993 Wiand .
5,212,910 5/1993 Breivogel et al. .
5,243,790 9/1993 Gagne ..... 51/209 R
5,470,273 11/1995 Mertens ..... 451/548
5,489,233 2/1996 Cook et al. .
5,578,362 11/1996 Reinhardt et al. .
5,672,095 9/1997 Morimoto et al. ..... 451/41

*Primary Examiner*—Timothy V. Eley
*Assistant Examiner*—Dung Van Nguyen
*Attorney, Agent, or Firm*—Joan Taft Kluger; Konrad H. Kaeding; Kenneth A. Benson

[57] ABSTRACT

This invention provides polishing pad tiles which, by virtue of their geometry and surface features, can be arranged to form mosaic pads having channels at the seams which facilitate the flow of polishing fluid during polishing of a workpiece.

21 Claims, 3 Drawing Sheets

MOSAIC POLISHING PADS AND METHODS RELATING THERETO

This application claims the benefit of U.S. Provisional Application No. 60/046,104 filed May 9, 1997.

BACKGROUND OF THE INVENTION

1. Field of the Invention

The present invention relates generally to polishing pads, particularly to those useful in semiconductor device manufacturing.

2. Discussion of Related Art

When a high degree of planarity and smoothness is required, polishing pad surfaces must be generally free from significant defects and irregularities, and polishing pads must be of uniform thickness. Large, substantially uniform, defect-free polishing pads are generally difficult to manufacture. Many conventional pad manufacturing processes result in large unusable portions of material. In addition, pad size is typically limited by pad manufacturing equipment capabilities and pad material limitations. As pad size increases, unwanted variations are common. By producing large polishing pads from smaller tiles these problems can typically be minimized or overcome. As discussed below, there are also other benefits of forming pads by tiling.

U.S. Pat. No. 5,212,910 describes a composite pad comprising a first layer of elastic material, a second, stiff layer and a third layer optimized for slurry transport. The second layer is segmented into individual sections physically isolated from one another in the lateral dimension. The segments, combined with the cushioning of the first layer, enable the pad to conform to longitudinal gradations across the wafer.

SUMMARY OF THE INVENTION

The present invention is directed to a polishing pad tile comprising, a front surface and a back surface substantially parallel to the front surface and a periphery surface linking the front and back surfaces. The pad tiles have a shape allowing for alignment of tiles to form single, larger pads in a mosaic fashion. The periphery surface of the pad has a geometric profile which, when pads are aligned with one another a seam between tiles occurs along the periphery surfaces and the seam is recessed below the front surface thereby creating a channel which facilitates the flow of polishing fluid during polishing of a workpiece. The channels may enhance polishing performance. Furthermore, the channels function to reduce runoff of polishing fluids.

The present invention is further directed to methods for producing the mosaic pads formed from the pad tiles which include simply aligning the pad tiles and, optionally attaching a continuous nonporous substrate to the back surfaces of the tiles.

The present invention is further directed to a method for polishing comprising, aligning polishing pad tiles, such as those described above, to form a single mosaic pad, placing a polishing fluid into an interface between a workpiece and the polishing pad, and having the workpiece and pad move in relation to one another thereby polishing or planarizing the workpiece.

DETAILED DESCRIPTION OF THE PREFERRED EMBODIMENTS

Overview

Figure 1A:
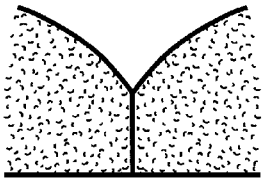
FIGS. 1, A–E show examples of cross-sectional views of polishing pad tile seams showing the profile of the periphery surface.

The present invention is directed to polishing pad tiles which, by virtue of their geometry and surface features, can be arranged to form mosaic pads of nearly limitless size and of generally uniform structure. The invention is further directed to the mosaic pads, a method for producing the mosaic pads and a method for polishing. The term, "polishing" or any form of the word, as used herein, includes smoothing and planarizing of surfaces.

Uses and Advantages of the Present Invention

The polishing pad tiles and related methods of the present invention are particularly useful in the semiconductor industry for polishing metal disks, integrated circuits and silicon wafers. The present invention may also be useful in other industries and can be applied to any one of a number of materials, including but not limited to, silicon, silicon dioxide, metals, polymers, dielectrics, ceramics and glass.

Semiconductor device fabrication requires a high degree of planarity and smoothness. This necessitates polishing pad surfaces being generally free from significant defects and irregularities, and having uniform thickness. Large, substantially uniform, defect-free polishing pads are generally difficult to manufacture. Many conventional pad manufacturing processes result in large unusable portions of material. By piecing together small tiles to form large pads, the amount of unusable material is decreased, thereby improving yields. Pad size is also typically limited by pad manufacturing equipment capabilities and pad material limitations. As pad size increases, unwanted variations are common. These problems can be minimized or overcome by producing relatively small pad tiles which can be aligned to form larger pads.

The present invention also typically overcomes problems that would be associated with attaching pads directly to a platen. Tiles of the present invention may be mounted on a continuous sheet which generally prevents polishing fluid from reaching the platen.

Difficulties in piecing together pad tiles include 1) producing a seam that will neither interfere with nor be adversely affected by polishing, and 2) creating a level polishing surface. The present invention generally addresses these problems in two ways: First, seams are recessed diminishing interference with the workpiece. Second, the polishing surfaces of the tiles are used as a reference level when creating a mosaic pad, translating any unevenness to the tiles' back surfaces. By shifting any unevenness to the back surface there is little or no interference with the polishing process. A method of the present invention provides placing pad tile polishing surfaces on a level surface then applying a backing to the tile back surfaces. (The term, "seam" as used herein, includes the area between adjacent tiles, whether tiles abut one another or whether a space exists between tiles.)

Recessed seams also serve to enhance the polishing process facilitating the flow of polishing fluid. Furthermore, the seams provide a barrier to polishing fluid run-off.

The present invention further enhances polishing performance by virtue of the uniform pad tile thickness. The smaller tile size typically allows for fewer variations throughout the pad, generally giving rise to more repeatable and predictable polishing results. Pad tile uniformity of the present invention typically allows for firm contact between the pad and the workpiece throughout the pad surface. Firm contact generally gives rise to enhanced surface quality, increased removal rate and increased planarization rate.

In addition, as pad width increases stiffness decreases, adversely affecting polishing performance for some applications. Therefore, smaller pads are generally more desirable in order to obtain the extremely smooth and planar surfaces required in the manufacturing of semiconductor devices and for other possible applications.

Mosaic pads, according to the present invention, may also be created from a combination of tiles of different materials. This may enable two processes to occur simultaneously that would normally occur in succession. In addition, tiles with different desirable characteristics may be combined to form a single pad containing a combination of characteristics that would otherwise not be easily attainable.

A further advantage is the ability to produce pads shaped to conform to curved workpieces. Concave, convex or other similarly curved shaped pads can be easily produced. Such shapes may diminish center-fast or center-edge polishing. This feature may also be desirable when combining concentric tiles of different materials that may require different polishing pressures.

Additionally, it has been found that the present invention is advantageous because seams between tiles diminish the vacuum created between the pads and workpieces, facilitating the release of workpieces after polishing.

Furthermore, the present invention is particularly advantageous because it overcomes limitations in pad manufacturing equipment capabilities and limitations of pad materials. For example:

1) The size of injection molded pads is limited by the length to thickness ratio of the pad. Beyond the ratio limit, back pressure reaches a level that inhibits filling of the mold.
2) The size of sintered pads is limited by the press size necessary for the sintering process.
3) For polymer impregnated felt pads, limitations on size include the felt width and polymer uniformity. It is difficult to manufacture felt with large widths due to roller deflection. Variations over large areas occur in the polymers due to material flow.
4) Rigid microporous polyurethane pad size is limited by the ability to produce large pads of uniform thickness.

Details of the present invention will now be described.

Description of Polishing Pad Tiles and Mosaic Pads

The polishing pad tiles of the present invention preferably comprise a front surface for polishing and a back surface. Preferably the back surface is substantially parallel to the front surface. A periphery surface links the back and front surfaces.

The pad tiles have a geometry allowing for alignment to form larger, mosaic pads. Preferably, the periphery surface has a profile which allows for seams that neither interfere with nor are adversely affected by the polishing process.

An important feature of the present invention is that when pad tiles are aligned, the periphery surface profiles create channels that generally facilitate the flow of polishing fluid, typically enhancing polishing performance. The channel resulting at the seams can also create a reservoir that can function to trap particles that would otherwise contribute to scratching or decrease in effectiveness of the pad. The reservoir may also serve to hold polishing fluid and create a pumping action for enhanced fluid flow. Furthermore, the channels inhibit polishing fluid run-off, maintaining a more uniform fluid distribution across the pad surface. The profile shape may be incorporated as the tile is being formed such as in casting or molding. In an alternative embodiment, the periphery profile may be incorporated after pad formation such as by embossing, cutting or other similar means.

In one embodiment of the present invention the profile of the periphery surface profile is a straight line perpendicular to the front and back surfaces. Preferably the edge defining the intersection of the front surface and the periphery profile is beveled, more preferably the edge is rounded as shown in FIGS. 1A and C. To obtain the front surface of a pad tile with a beveled edge, the periphery surface comprises a straight line perpendicular to the front and back surfaces and a straight line ending at the front surface. To obtain the front surface of a pad tile with a rounded edge, the periphery surface comprises a straight line perpendicular to the front and back surfaces and a curved line ending at the front surface.

Figure 1B:
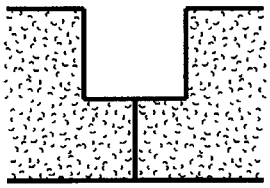
Figure 1C:
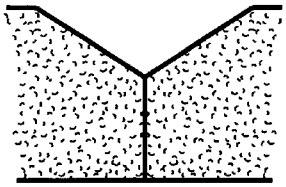

In an alternative embodiment the periphery surface profile is a step shape, as shown in FIG. 1B, comprising two straight lines perpendicular to the front and back surfaces.

Figure 1D:
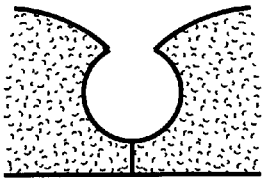

In yet another embodiment, the periphery surfaces form a reservoir at the seam as shown in FIG. 1D. However, the reservoir is not limited to the shape shown.

Figure 1E:
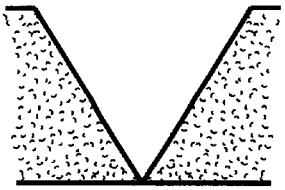

FIG. 1E shows yet another possible periphery profile in which the channel formed extends to the bottom surfaces of the pad tiles.

It should be noted that possible profiles are not limited to those shown in FIGS. 1A–E.

Pad tile formation may be accomplished by numerous known manufacturing methods and may be comprised of various known materials. Periphery profiles may be incorporated into the pad tile at any time during or after pad formation. For instance, profiles may be molded or cast during pad formation or may be milled or cut after the pad has been formed. Any technique capable of shaping the periphery surface may be incorporated into the process.

Examples of pad materials include, but are not limited to:

1. Urethane impregnated polyester felts such as are described in U.S. Pat. No. 4,927,432;
2. Polymerics impregnated with polymeric microelements such as described in U.S. Pat. No. 5,578,362.
3. Microporous polymers such as the type sold as Politex by Rodel, Inc. of Newark, Del.;
4. Solid homogeneous polymer sheets;
5. Abrasive-filled polymers such as those described in U.S. Pat. No. 5,209,760; and
6. Filled and/or blown composite urethanes such as IC-series, MH-series and LP-series manufactured by Rodel, Inc. of Newark, Del.

One of ordinary skill in the art would understand that any other material capable of being formed into pads having the periphery profiles of the present invention may be used. Furthermore, any method of forming or producing such materials may be used in keeping with the spirit and scope of the present invention.

Figure 2A:
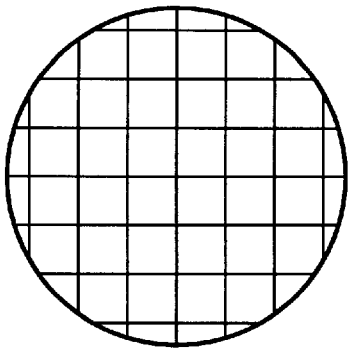
FIGS. 2, A–E show examples of polishing pad tiles aligned to form single mosaic polishing pads.
Figure 2B:
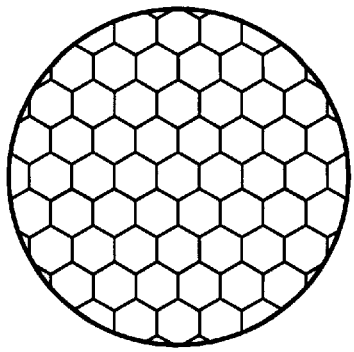
Figure 2C:
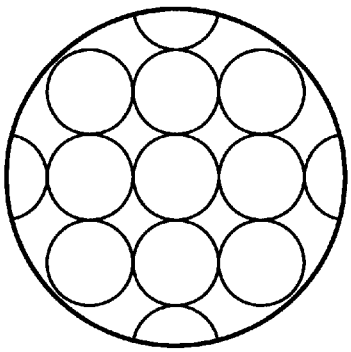
Figure 2D:
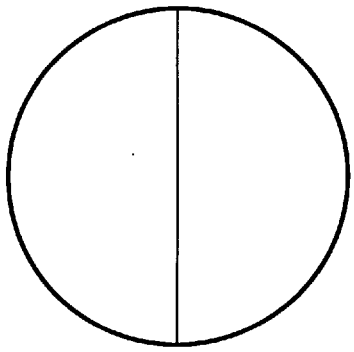
Figure 2E:
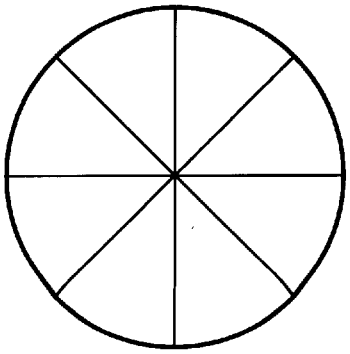

The pad tile front and back surfaces may be any shape capable of being aligned to form a mosaic pad. Mosaic pads may be formed by alignment of like tiles or by combinations of different shaped tiles. In one embodiment of the present invention the pad tile shape is a square as shown in FIG. 2A. Square shaped pad tiles can be staggered, or aligned to form rows and columns of tiles. In another embodiment pad tiles are triangular. More preferably pad tiles have a hexagonal shape and produce a honeycomb pattern when aligned to form a mosaic pad as shown in FIG. 2B. Pad tiles may also be semicircular or pie-shaped as shown in FIGS. 2D and E, respectively. In an alternative embodiment, as shown in FIG. 2C, a combination of circular and noncircular pad tiles are aligned to form a mosaic pad. Circular tiles simplify alignment because there are no directional orientation restrictions.

Figure 3:
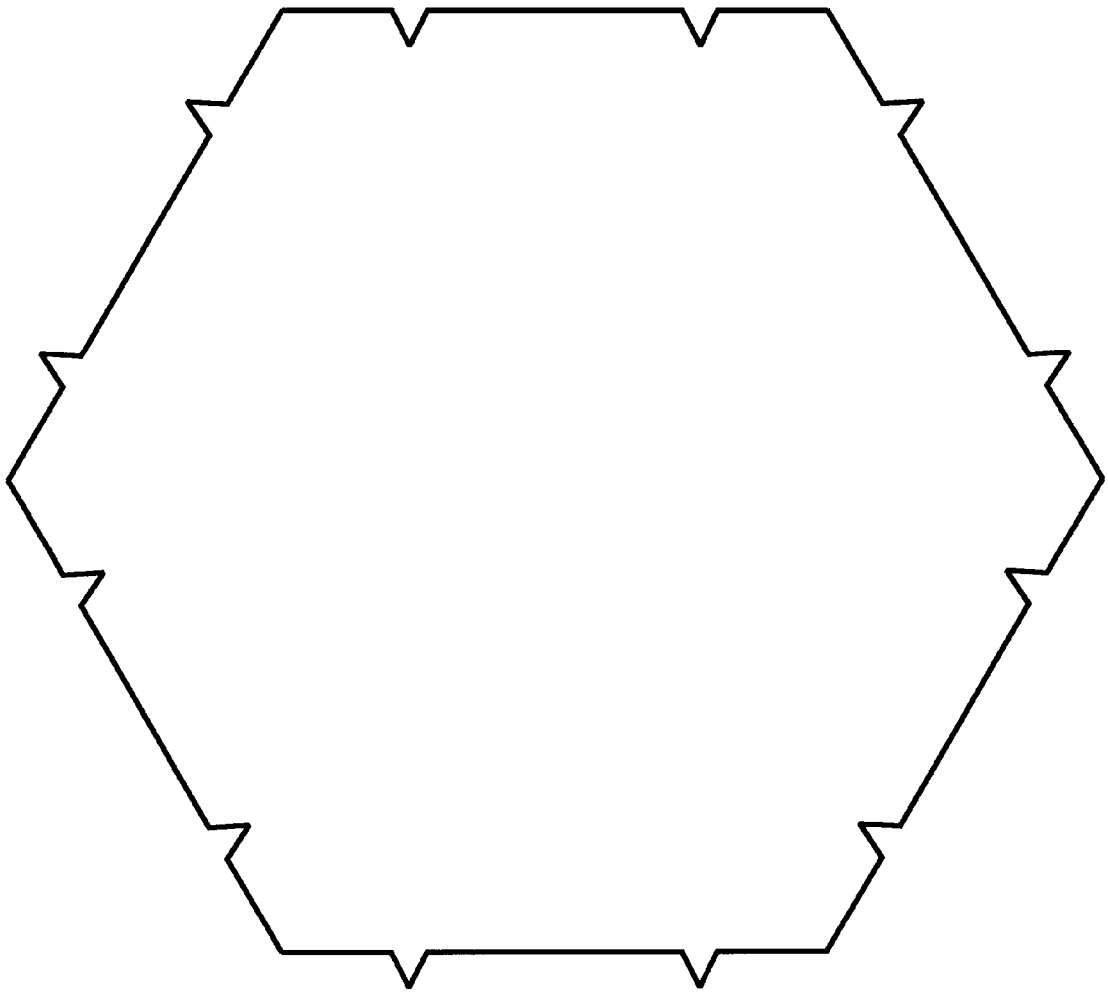
FIG. 3 shows a polishing pad tile with periphery protrusions and complimentary indentations.

In one embodiment of the present invention, as shown in FIG. 3, hexagonal pad tiles include protrusions extending perpendicularly from three alternating sides of the hexagon and complimentary indentations extending perpendicularly from the remaining three sides. The indentations and protrusions facilitate tile alignment by allowing only specific pad tile orientations. Such indentations and protrusions may be incorporated into any shaped tile.

Method for Producing Mosaic Pads

In a preferred embodiment, pad tiles are aligned with their polishing surfaces placed on top of a level platform. A continuous, nonporous, supporting substrate such as a thin plastic (for instance PET film) or a thicker substrate such as plastic, metal or a laminate sheet is then attached to top of the tiles adjacent to the tile's back surface. The nonporous substrate generally prevents polishing fluid from reaching the platen or other apparatus.

In an alternative embodiment convex, concave or other shaped pads are created by placing tiles on a complimentary contoured form as opposed to the level surface used for flat pads.

In an alternative embodiment mosaic pads may be created by aligning pad tiles on top of the continuous, nonporous substrate. In all embodiments, pad tile may be aligned manually, mechanically, by an automated system, or any combination thereof.

In yet another embodiment, a liquid, viscous solid or viscous elastic material is applied to the tiles' back surfaces. The material may be self-leveling or may acquire a level surface upon application of a rigid or semi-rigid material on top.

Once tiles have been assembled into a mosaic pad, it may be attached to a platen for polishing or to other equipment as necessary. Attachment may be accomplished by use of an adhesive applied to either the pad tile or sheet. In one embodiment pad tiles comprise a layer of pressure sensitive adhesive attached to the back surface.

Method for Producing Pad Tiles

Pad tiles of the present invention may generally be produced by any means currently used to create polishing pads. Methods may include, but are not limited to, molding, casting, sintering, and impregnation of felt with urethane.

Method for Polishing

Polishing according to the present invention is accomplished by creating pad tiles having a geometry as described above, then aligning the tiles to form a larger pad. A polishing fluid is placed into an interface between a workpiece and the polishing pad. The workpiece and the pad are moved in relation to one another thereby smoothing or planarizing the workpiece.

EXAMPLE

Thirty-six silicon 100P, acid wafers were polished using a mosaic pad. The periphery surface profile of the tiles was a straight line extending perpendicularly from the front surface to the back surface. Seams were not recessed. Pressure sensitive adhesive was used to mount the tiles to a PET sheet, and to mount the mosaic pad to a platen.

Pad characteristics were as follows:

Pad material: Suba 500, manufactured by Rodel, Inc. of Newark, Del.

Tile shape: hexagonal

Tile size: 12 inches as measured perpendicularly from side to opposite side

Total mosaic pad diameter: 36 inches

Polishing was performed on a Siltec 3800 polishing machine. The polishing parameters were as follows:

Time: 20 minutes

Down force: 5.5 psi at the wafer face

Platen speed: 60 rpm

Carrier speed: 60 rpm

Slurry flow: 250 ml/minute

Slurry type: Nalco 2350, a silica based slurry for stock polishing, diluted 20 parts DI $H_2O$ to 1 part slurry.

For comparison, twenty-three wafers were polished using a 36 inch Suba 500 pad under the same conditions. The results were as follows.

| Pad | Average Removal Rate ($\mu$/min) | Roughness of Polished Wafers (Angstroms) |
|---|---|---|
| Comparison | 1.06 ± 0.04 | 14.41 ± 1.61 |
| Mosaic | 1.00 ± 0.06. | 13.06 ± 0.79 |

The comparison pad and the mosaic pad of the present example had similar removal rates and achieved similar wafer surface roughness.

The above Example and discussion is not meant to limit the invention in any way. The scope of the invention is limited only by the claims which follow:

What is claimed is:

1. A method for polishing comprising:

(A) aligning polishing pad tiles to form a mosaic pad, each said polishing pad tile comprising:

a) a laterally extending front surface and a back surface substantially parallel to the front surface;

b) a periphery surface linking said front and back surfaces, an intersection of said periphery surface and said front surface being laterally recessed with respect to an intersection of said periphery surface and said back surface;

c) said pad tiles having a shape allowing for lateral alignment of said tiles wherein a seam between adjacent said tiles is defined by opposed said periphery surfaces and said seam is wider at said front surfaces of said adjacent tiles than at said back surfaces of said adjacent tiles, thereby creating a channel which facilitates the flow of polishing fluid, (B) placing a polishing fluid into an interface between a workpiece and said mosaic pad, and (C) having said workpiece and said mosaic pad move in relation to one another, thereby polishing or planarizing said workpiece.

2. A polishing pad tile comprising:

a) a laterally extending front surface and a back surface substantially parallel to the front surface;

b) a periphery surface linking said front and back surfaces, an intersection of said periphery surface and said front surface being laterally recessed with respect to an intersection of said periphery surface and said back surface;

c) said pad tile having a shape allowing for lateral alignment with other said pad tiles wherein a seam between adjacent said tiles is defined by opposed said periphery surfaces and said seam is wider at said front surfaces of said adjacent tiles than at said back surfaces of said adjacent tiles, thereby creating a channel which facilitates the flow of polishing fluid during polishing of a workpiece.

3. A pad tile in accordance with claim 2 wherein the profile of said periphery surface comprises a straight line perpendicular to said front and back surfaces and a straight line ending at said front surface such that said front surface of said pad file has a beveled edge.

4. A pad tile in accordance with claim 2 wherein the profile of said periphery surface comprises a straight line perpendicular to said front and back surfaces and a curved line ending at said front surface such that said front surface of said pad tile has a rounded edge.

5. A pad tile in accordance with claim 2 wherein the profile of said periphery surface comprises two straight lines perpendicular to said front and back surfaces wherein said profile is a step shape.

6. A pad tile in accordance with claim 2 wherein the profile of said periphery surface comprises a straight line forming an angle in the range of 30 degrees to 90 degrees from the bottom surface.

7. A pad tile in accordance with claim 2 wherein the shape of said front and back surfaces is hexagonal.

8. A pad tile in accordance with claim 2 wherein the shape of said front and back surfaces is square.

9. A pad tile in accordance with claim 2 wherein the shape of said front and back surfaces is triangular.

10. A pad tile in accordance with claim 2 wherein the shape of said front and back surfaces is semicircular.

11. A pad tile in accordance with claim 2 wherein the shape of said front and back surfaces is pie-shaped.

12. A pad tile in accordance with claim 2 wherein the tiles are produced by molding.

13. A pad tile in accordance with claim 2 wherein a plurality of protrusions extend from the pad tile periphery on or parallel to the plane of the pad surfaces, and a plurality of indentations complimentary to the protrusions extend into the pad tile to facilitate tile alignment.

14. A mosaic pad comprising:

a plurality of pad tiles laterally aligned to form said mosaic pad, wherein each said pad tile comprises:

a) a laterally extending front surface and a back surface substantially parallel to the front surface; and b) a periphery surface linking said front and back surfaces, an intersection of said periphery surface and said front surface being laterally recessed with respect to an intersection of said periphery surface and said back surface;

wherein a seam between adjacent said tiles is defined by opposed said periphery surfaces and said seam is wider at said front surfaces of said adjacent tiles than at said back surfaces of said adjacent tiles, thereby creating a channel which facilitates the flow of polishing fluid during polishing of a workpiece.

15. A method for producing a mosaic pad comprising:

laterally aligning polishing pad tiles, wherein each said tile comprises:

a) a laterally extending front surface and a back surface substantially parallel to the front surface; and b) a periphery surface linking said front and back surfaces, an intersection of said periphery surface and said front surface being laterally recessed with respect to an intersection of said periphery surface and said back surface;

wherein a seam between adjacent said tiles is defined between opposed said periphery surfaces and said seam is wider at said front surfaces of said adjacent tiles than at said back surfaces of said adjacent tiles, thereby creating a channel which facilitates the flow of polishing fluid during polishing of a workpiece.

16. A method in accordance with claim 15 wherein said pad tiles are all of the same shape.

17. A method in accordance with claim 15 wherein said pad tiles are of two or more shapes.

18. A method in accordance with claim 15 wherein pad tiles of two or more different materials are aligned with one another.

19. A method in accordance with claim 15 further comprising: placing and aligning pad tiles on a level platform, having the front surfaces in contact with the platform, and attaching a continuous nonporous substrate to the back surfaces.

20. A method in accordance with claim 15 further comprising: placing and aligning pad tiles on a curved form, having the front surfaces in contact with the curved form, and attaching a continuous nonporous substrate to the back surfaces.

21. A method in accordance with claim 15 further comprising placing and aligning pad tiles on a level platform, having front surfaces in contact with the platform, distributing a self-leveling material over the back surfaces of the tiles and attaching a continuous nonporous substrate to the self-leveling material.

* * * * *